US005337726A

United States Patent [19]

Wood

[11] Patent Number: 5,337,726

[45] Date of Patent: Aug. 16, 1994

[54] HAND HELD PNEUMATIC POWERED BALL THROWER

[76] Inventor: Michael J. Wood, 22 Columbus, Irvine, Calif. 92720

[21] Appl. No.: 958,227

[22] Filed: Oct. 8, 1992

[51] Int. Cl.[5] ..... F41B 11/00; F41B 11/32

[52] U.S. Cl. ..... 124/61; 124/73; 124/75

[58] Field of Search ..... 124/56, 61, 70, 71, 124/73, 75

[56] References Cited

U.S. PATENT DOCUMENTS

| | | | |
|---|---|---|---|
| 2,818,056 | 12/1957 | Martin | 124/72 |
| 3,233,601 | 2/1966 | Walther | 124/73 X |
| 3,308,803 | 3/1967 | Walther | 124/70 X |
| 4,086,902 | 5/1978 | Reynolds | 124/61 |
| 4,280,248 | 7/1981 | Herubel | 124/61 X |

FOREIGN PATENT DOCUMENTS

| | | | |
|---|---|---|---|
| 519777 | 5/1953 | Belgium | 124/56 |
| 941917 | 1/1949 | France | 124/73 |
| 524447 | 4/1955 | Italy | 124/61 |
| 2118443 | 11/1983 | United Kingdom | 124/61 |

*Primary Examiner*—Randolph A. Reese
*Assistant Examiner*—John Ricci
*Attorney, Agent, or Firm*—Harness, Dickey & Pierce

[57] ABSTRACT

A pneumatic driven ball thrower employing a pressurized gas to move a piston and connecting rod against a ball at rapid velocity to move the ball a pre-determined velocity. The pressurized gas ram at a pre-determined amount of pressurized gas in a very brief period of time to rapidly accelerate the piston and rod. The device employs a pressurized gas reservoir in proximity to the pressurized gas ram employing a valve with a large gas passage which opens rapidly permitting rapid passage of the pressurized gas from the gas reservoir to the pressurized gas ram.

9 Claims, 5 Drawing Sheets

HAND HELD PNEUMATIC POWERED BALL THROWER

BACKGROUND OF THE INVENTION

This invention is directed towards a device for throwing or projecting a ball. The device can be used for training and exercising ball players, such as, professional players, school team players, semi-pro players, little league players and the like.

In many games, such as, baseball, softball and cricket, the catching and batting of the ball is an important aspect of the game. The catching and batting of the ball requires good eye/hand coordination, even though some athletes have natural excellent eye/hand coordination, a majority of the population do not, and must practice to develop this coordination and skill. On Little League teams, junior high and high school teams, college teams, semi-pro teams, intramural sports teams, business league teams and professional teams, the catching and batting of balls is practiced on on-going basis to improve the skills of the player and to maintain their skills at a proficient level. Catching skills are normally enhanced by having a batter hit easy balls or by having one (1) or more players throw to the other players. These are excellent ways to enhance catching skills since they also allow the batter to practice his batting skills or the thrower to practice his throwing skills. Unfortunately, the batter is normally not able to control a hit ball as well as he'd like, either in direction, speed, height, distance or the like. Throwers can control their throws, but as their arms become exhausted they lose control, especially with respect to speed and distance. What is needed is a device that requires very little effort on the part of the operator to throw and pitch balls at a predetermined speed or a predetermined distance to players. Preferably the device can be operated by one (1) person who can rapidly throw balls to a number of players located at different positions in the field or throw controlled pitches. Ideally, the thrower can be used to practice catching for the catcher, short-stop, the basemen and the fielders. The device can also be used for batting practice. The device would also be useable for softball and cricket. The device also could be used in tennis, handball, racquetball, and other types of sports where a projected ball is required to practice a particular technique.

The present device meets these needs, the present device can rapidly throw a ball at a predetermined speed at any chosen angle, chosen direction and/or chosen height. It can be used in baseball, softball, cricket, tennis, handball, racquetball, squash and the like. The device is lightweight, it can use a reservoir of compressed gas which can either be mounted on the device or which can be supplied from a tank via a conventional pressure hose, and it can utilize commonly available pressurized gases, such as air, argon, carbon dioxide and the like. Combustible gases and oxygen are not recommended for safety reasons. However, under strictly controlled conditions these gases might be suitable.

SUMMARY OF THE INVENTION

The present device operates on a pneumatic system employing pressurized gas to move a piston and connecting rod against a ball at rapid velocity to move the ball to a predetermined velocity. The pressurized gas ram is fed a predetermined amount of pressurized gas in a very brief period of time to rapidly accelerate the shuttle comprising the piston and rod. The more rapid the pressurized ram is exposed to the pressurized gas, the greater is the acceleration of the shuttle. For a given initial ball velocity, i.e. muzzle velocity, as it leaves the ball guided device, the more rapidly the shuttle is accelerated, the shorter the shuttle stroke can be to obtain the desired velocity. In turn, greater acceleration of the shuttle is obtained when the pressurized gas ram receives the charge of pressurized gas in the shortest period of time, preferably less than ten milliseconds. Such a device requires short passages between the pressurized gas reservoir and the pressurized gas ram, a valve that opens rapidly and a valve passageway that offers little constraint to the passage of the pressurized gas. These objectives have been met in the present device.

The pneumatic driven ball thrower of the present invention comprises a first plenum adapted to receive and store pressurized gas, a shuttle comprising a piston and connecting shuttle rod adapted to be driven by the pressurized gas in said first plenum and to drive a ball to a predetermined velocity; a tube having first and second opposing ends adapted to slidably receive the piston in a gas tight relationship to guide the piston when driven pneumatically from the first end towards the second end of said tube; a second plenum situated at the first end of said tube to receive the pressurized gas from said first plenum, the piston forming one wall of said second plenum, the second plenum expanding when said piston is driven by pressurized gas admitted into the second plenum from said first plenum; a quick release valve for releasing pressurized gas from the first plenum into the second plenum in less than 0.01 seconds; and a ball guide having open opposing first and second ends, the first end of said ball guide secured to the second end of said tube, said piston adapted to drive said shuttle rod within said ball guide to drive a ball along and out of said ball guide to a predetermined velocity.

Preferably the first plenum has a first predetermined volume and the second plenum has a second predetermined stroke volume. The ratio of the first predetermined volume and second predetermined stroke volume to the first predetermined volume being between about 1 to 2 and about 1 to 5.

Preferably the pneumatic driven ball thrower has at least one gas release vent in the wall of said tube located at a predetermined distance from its first end so that when the piston is driven towards the second end at said tube and past the gas release vent, the pressurized gas in said first and second plenums exhausts through said gas release vent to the atmosphere. Preferably the second end of the tube is capped with an end plate, the end plate having a bore to slidably receive and guide the shuttle rod, said tube, piston and end plate forming a third plenum, said third plenum acting as an accumulator when said piston is driven down the tube past said gas release vent to break the motion of the shuttle.

The pneumatic driven ball thrower has the first end of said tube is adapted to be sealed off with a first valve, the first valve sealing off said first plenum from said second plenum, said first valve actuated by a pressurized gas from a fourth plenum, release of the pressurized gas from the fourth plenum rapidly opening said first valve causing pressurized gas from the first plenum to enter the second plenum and drive the shuttle down the tube. In one embodiment of the invention, said first valve comprises a flexible elastomeric diaphragm backed by a fourth plenum which can receive and store pressurized gas, the pressurized gas in the fourth plenum causing the elastomeric diaphragm to stretch and seal and cover the first end of said tube to seal off said first plenum from said second plenum, the release of the pressurized gas from the fourth plenum causing the elastomeric diaphragm to contract rapidly back to its original shape and rapidly opening a gas passage for pressurized gas from said first plenum to said second plenum.

In a preferred embodiment, the fourth plenum is connected to a three-way valve which permits the fourth plenum to be charged with pressurized gas or to vent the pressurized gas in the plenum to the atmosphere. In a preferred embodiment, the flexible diaphragm forms one wall of said first plenum and the diaphragm adjacent the area of said first plenum having a small hole communicating between said first plenum and said fourth plenum which permits the first plenum to be charged with pressurized gas from the fourth plenum when the fourth plenum is charged with pressurized gas, the hole in said diaphragm having a cross-sectional area less than one percent of the cross-sectional area of the gas passage between said first plenum and said second plenum when said first valve is open.

In another embodiment of the pneumatic driven ball thrower, said first valve comprises a flexible elastomeric U cup which covers and seals off the first end of said tube and seals said first plenum from said second plenum, the back side of said U cup forming one wall of a fourth plenum which is adapted for receiving and storing pressurized gas, the U cup adapted to move in and out of the fourth plenum to open and close the first end of said tube, pressurization of the fourth plenum with gas causing the U cup to move out of the fourth plenum and seal the first end of said tube, the pressurized gas deflecting the edges of the U cup causing pressurized gas to escape from the fourth plenum into the first plenum until the gas pressure in said first pressure and said fourth plenum are equal wherein the U cud restores its original shape and seals off said first plenum from said fourth plenum, the release of pressurized gas from the fourth plenum causing said U cup to move rapidly into said fourth plenum causing rapid opening of a gas passage between said first plenum and said second plenum to drive said shuttle.

In a preferred embodiment of the present invention, the shuttle rod is hollow and has biasing means extending within the shuttle rod and along the length thereof. One end of the biasing means is connected to the U cup and the other end of the biasing means is attached to the first end of the shuttle rod, the biasing means forcing the shuttle to return to the first end of said tube and forcing said U cup to move out of said fourth plenum and seal off said first plenum from said second plenum when the gas in said first plenum and said second plenum have been vented to about atmospheric pressure.

DETAILED DESCRIPTION OF THE PREFERRED EMBODIMENTS OF THE INVENTION

Figure 1:
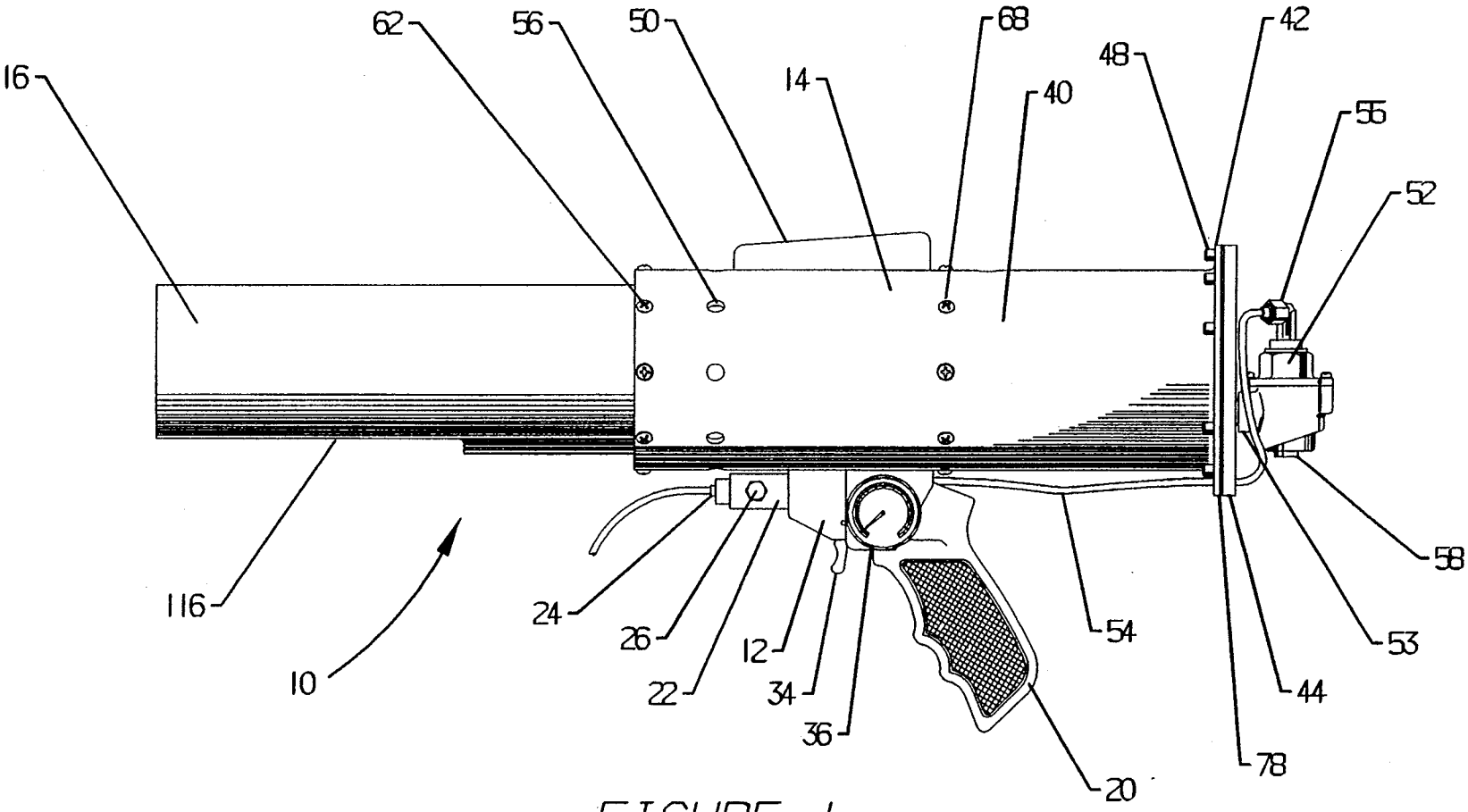
FIG. 1 is a side view of one embodiment of the pneumatic driven ball thrower of the present invention.

Referring to FIG. 1, the pneumatic driven ball thrower pin of the present invention comprises a handle assembly 12 connected to a housing assembly 14 and a ball guide 16 attached to the housing assembly. The housing assembly has a hand grip 20, a three-way valve 22 with an inlet port 24 and an exhaust port 26, a trigger 34 and a gas pressure gauge 36. The housing assembly 14 comprises a housing cylinder 40 having a phalange 42 at its back end. An end plate 44 is attached to the phalange by machine screws 48. To seal the end plate to the phalange, an elastomeric diaphragm such a rubber diaphragm 78, is positioned between the phalange and the end plate forms a seal when the screws are tightened down. A three-way valve 52 is secured to the back of the end plate 44 and communicates within the cylindrical housing 40 as will be shown later. The three-way valve has a inlet/outlet port 53 in communication with the interior of the cylindrical housing, an inlet port 55 which is connected to valve 22 by a gas tube 54, and an exhaust port 58. A sight 50 is attached to the top of the cylindrical housing 40. Towards the front end of the cylindrical housing, there are plurality of exhaust vent 56 that perforate the wall of the cylindrical housing.

Figure 2:
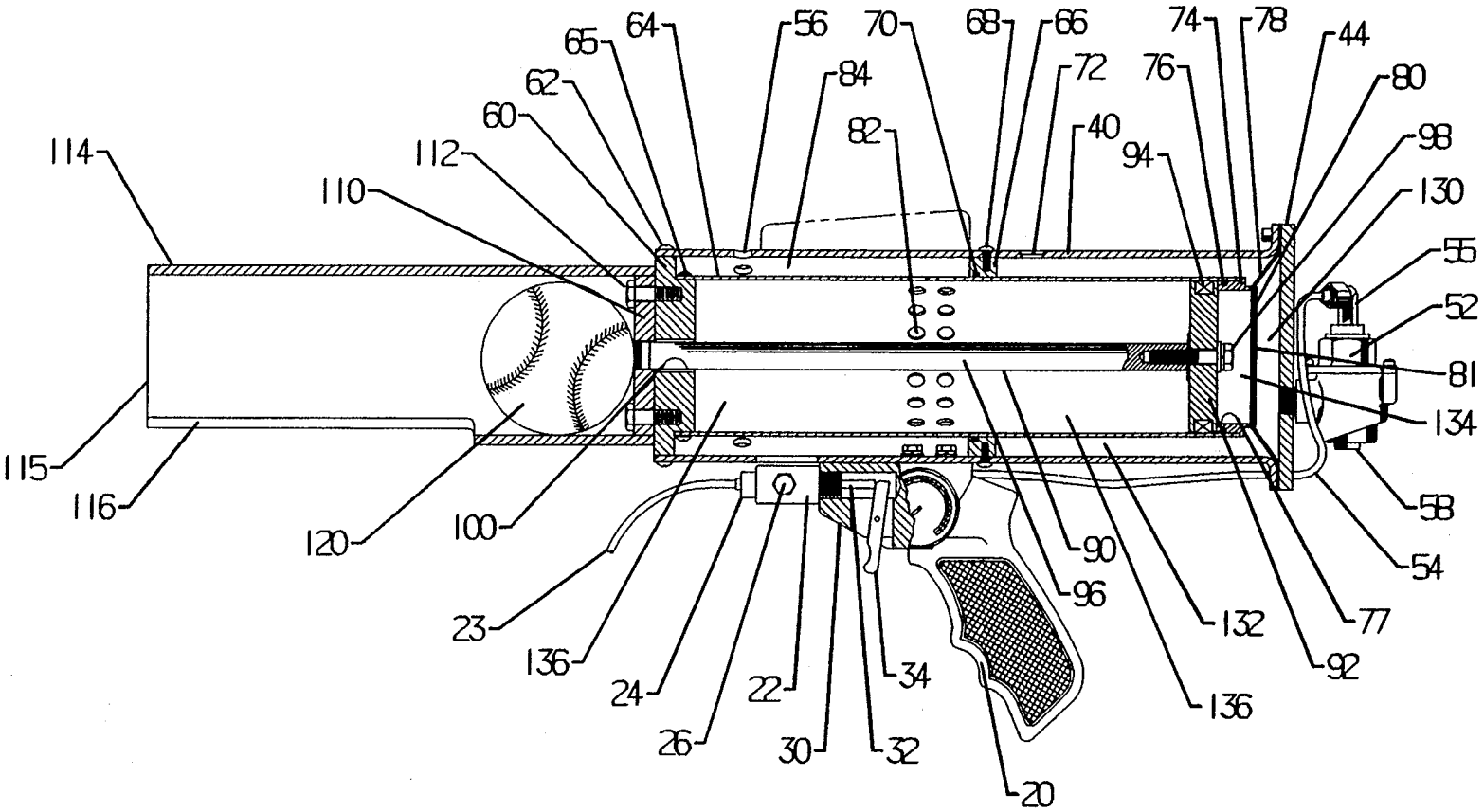
FIG. 2 is a side cross-sectional view of the device of FIG. 1.

Referring to FIG. 2, pressurized gas is fed from a reservoir (not shown) through gas tubing 23 to the valve 22. The valve is actuated by the trigger mechanism comprising the trigger rod 32 and the pivoted trigger 34. In its normal state, when pressurized gas is applied to the valve, the valve is open and supplies gas through an outlet port (not shown) through tubing 54 to the inlet port 55 of the three-way valve 52. When the trigger 34 is depressed, the inlet port 24 of the valve is shut and the exhaust port 26 is open to the outlet port 28 permitting gas to flow back through tube 54 into outlet port and out the exhaust port 26 to the atmosphere. The pressure regulator is connected to the tube 54 by a conventional T and gives a reading regarding the gas pressure in the tube 54 which is equivalent to the gas pressure in valve 52 and in the housing assembly when the system is fully charged up as will be described later.

Mounted within the cylindrical housing 40 is a pneumatic ram assembly comprising cylindrical tube 64 and a shuttle assembly comprising piston 92 and shuttle rod 90. The shuttle rod is connected to the piston by threaded bolt 98. The cylindrical tube is adapted to slidably receive piston 92. The piston is adapted to be driven down the length of the tube which in turn drives the rod down the tube towards an end to the ball guide 16. As will be explained later, the system is designed so that the rod cannot extend beyond the muzzle 115 of the ball guide. To ensure a good seal between the piston and the inner walls of the cylindrical tube 64, the piston is fitted with a circumferential flexible or elastomeric seal 94. Located about mid-way down the tube are a plurality of exhaust vents 82 which communicate with the exhaust plenum 84 which in turn communicates with the exhaust vent 56 and the cylindrical housing 40. The back end of the tube is fitted with a gas sealed relationship with a valve seat 74. The valve seat has a circumferential 0-ring situated between its outer wall and the tubes inner wall to form a gas seal. The valve seems to have a large throat 77 adapted for the passage of volume of gas at elevated pressures in a very brief period of time. Located behind the valve seat 74 is the elastomeric flexible diaphragm 78. A bracing plate 80 is attached to the back of the diaphragm to prevent the center of the diaphragm from rupturing. The diaphragm is shown in a position where it is formed a sealed relationship with the valve seat. In this operational mode, the space 134 between the piston and the front of the elastomeric diaphragm is considered the second plenum which is adapted to receive high pressure gas from the first plenum to drive the piston down the tube towards the ball guide 16. The space 130 between the back of the elastomeric diaphragm 78 and the inner side of the in plate 44 yet is a fourth plenum which is adapted to receive and store pressurized gas. When the fourth plenum is pressurized, the elastomeric diaphragm expands and forms a seal with the valve seat 74 sealing off the throat 77 from the first plenum 132. When the pressurized gas in the fourth plenum 130 is vented to the atmosphere, the elastomeric diaphragm because of its elastomeric nature collapses towards the inner wall of the end plate 44 opening quickly a large passage between the first plenum and the second plenum. The first plenum is adapted to store pressurized gas and to release the gas into the second plenum when the elastomeric diaphragm collapses as described above. The elastomeric diaphragm has a small orifice connecting the first plenum with the fourth plenum which permits pressurized gas to flow from the fourth plenum into the first plenum. When pressurized gas is supplied to valve 22 through tube 23, the gas flows through tube 54 and into valve 52 through inlet 55. The gas proceeds through the inlet/outlet port 53 into the fourth plenum. The gas expands the fourth plenum and expands the elastomeric membranes 78 forming the seal with valve seat 74. When the trigger in the handle assembly 12 is depressed, the valve 22 shuts off the gas supply entering into the inlet port 24 and opens the outlet port of that valve (not shown) to the atmosphere so exhaust port 26. This permits the pressurized gas and the three-way valve 52 to exit out of the valve through the inlet port 55 and the tube 54. When this occurs, valve 52 opens the inlet/outlet port 53 to the exhaust port 58 permitting the pressurized gas in the fourth plenum 130 to rapidly exhaust to the atmosphere. This in turn permits the elastomeric diaphragm to collapse back towards the inplate to rapidly open the passage between the first plenum containing pressurized gas to the second plenum which contains atmospheric pressure gas. The shuttle responds immediately to this massive transport of high pressure gas into the second plenum rapidly accelerating the piston and rod driving them down the tube towards the ball guide 16. The rod pushes the ball down the ball guide and out the muzzle at a predetermined velocity depended upon the pressure of the pressurized gas in the first plenum.

The first plenum is charged with gas at the same time that the fourth plenum 130 is charged with gas. The high pressure gas being fed to the fourth plenum is allowed to flow through an orifice 81 in the elastomeric membrane between the fourth plenum and the first plenum until the pressure in the fourth plenum and the first plenum are equalized. Because the orifice 81 is a small diameter, and the passageway from the fourth plenum through the valve 52 and out port 58 is considerably larger, very little gas escapes from the first plenum through the fourth plenum and through valve 52 to the atmosphere. When the valve is actuated as described above to drive the ball out of the ball guide, the elastomeric diaphragm collapses so rapidly against the inner wall of the endplate 44 that the orifice 81 is sealed off against the inner side of the end wall that virtually no pressurized gas in the first plenum escapes through the orifice and the pressurized gas is distributed between the first plenum and the second plenum rather than the first plenum, the second plenum and the atmosphere. In the event that the gas under excessive pressures is fed into the pneumatic driven ball thrower, the cylindrical housing 40 is fitted with a rupture disk 72 which will rupture creating an opening between the first plenum and atmosphere and preventing the cylindrical housing from bursting and causing injury.

It is described above, the ball wall of the first plenum is defined by the elastomeric membrane 78. The forward wall of the first plenum is created by the cylindrical bulkhead 66 which is attached to the outer cylindrical housing by machine screws 68. The inner circumferential side of the bulkhead 66 is fitting with an 0-ring 70 to form a seal between the tube 64 and the bulkhead. The space forward of the bulkhead 68 is the exhaust plenum 84 which has been described above.

As the shuttle is driven down the tube, it crosses over the area having the exhaust vent 82. When the piston crosses the exhaust vent 82, the pressurized gas originating from the first plenum and now distributed in the first plenum and second plenum can exhaust through the vents and the plenum 84 and out the vents 56 to the atmosphere and accordingly exhaust the driving force, i.e. the pressurized gas, on the shuttle. The space 136 between the end wall 60 and the piston 92 is accumulator space which is at atmospheric pressure when the piston is located behind the exhaust vent 82 towards the rear of the tube and which is at elevated air pressure when the piston is in front of the vents 82. When the piston moves down the tube past the vents 82, the air trapped between the walls of the tube 64, the inner wall of end wall 60 and the inner side of piston 92 becomes pressurized and begins to break the movement of the piston until the gas pressure in plenum 136 equals the force of the moving shuttle wherein the shuttle then comes to an immediate stop. The gas pressure in the fourth plenum then pushes the shuttle back towards the rear of the tube until the piston passes over the exhaust fence 82 permitting the gas pressure, if any, in the fourth plenum to exhaust to atmosphere. The shuttle can be returned with initial position by pushing the end of the rod towards the base plate 110 through the ball guide 16 using a baseball 120. After the ball is projected from the pneumatic driven ball thrower 10, the trigger 34 is depresses permitting pressurized gas flow into tube 54 through valve 52 into the fourth plenum 130 thereby sealing the second plenum and permitting gas to flow through the aperture in the elastomeric membrane into the first plenum until the gas pressure in the first plenum and the fourth plenum are equivalent to the gas being supplied to the device through tube 23.

The cylindrical tube 64 is supported in the housing assembly 14 by bulkhead 66 and end wall 60. The end wall 60 has a bore 100 slightly larger than the outer diameter of the shuttle rod 90. The end wall guides a shuttle rod during operation. The ball guide is a cylindrical element having wall 114 with a slot extending down about ⅔ the length of the ball guide from the muzzle 115. The slot is open so that a ball can be inserted into the ball guide and pushed with the fingers against the shuttle rod to move the shuttle rod and piston back to their starting position. The rear end of the ball guide is secured to a base plate 112 which has bore 113 slightly larger diameter in the shuttle rod and co-axle with the shuttle rod. The base plate is secured to the end wall by threaded bolts 112. When the device is used to throw balls for catching or the like, the axis of the shuttle rod and ball guide are co-axis. For pitching, the ball guide and bore 113 can be off-center with respect to the rod so that the ball is propelled off-center by the rod to put spin on the ball.

The shuttle rod is solid at its rear end but it is hollow for a substantial portion of its length to make the shuttle rod as light as possible. The shuttle rod is fitted with an elastomeric tip 97 to prevent the hollow shuttle rod from nicking the baseball.

Figure 3:
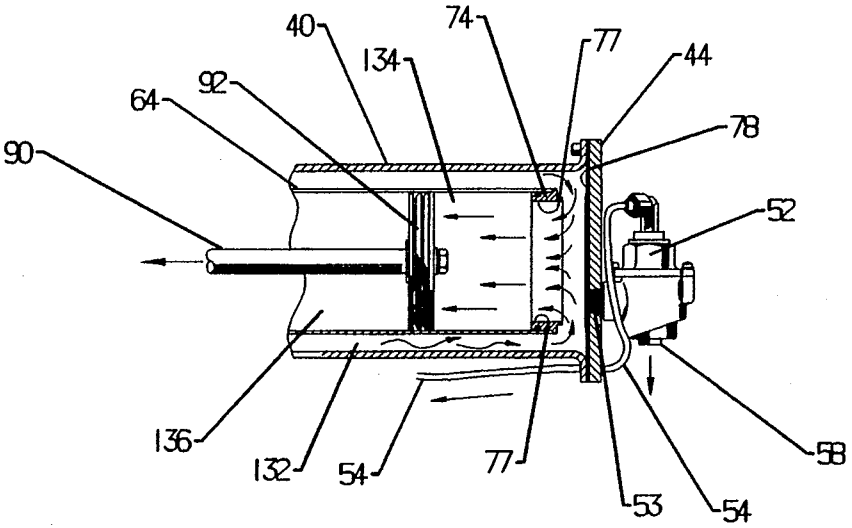
FIG. 3 is a partial side cross-sectional view similar to FIG. 2 showing the operation of the pneumatic driven ball thrower of FIG. 1.

FIG. 3 shows the operation of the piston and shuttle rod and elastomeric diaphragm 78. The arrows in the first plenum 132 show the flow of gas from the plenum into the second plenum and the arrows in the second plenum show the gas being supplied into the second plenum which is expanding as the piston is being driven down the tube 64. The arrow line parallel to tube 54 shows the direction of the pressurized gas in tube 54 when the pneumatic driven ball thrower is activated. The arrow underneath exhaust port 58 shows the outflow of gas from the exhaust port 58 of valve 52. The arrow in front of the shuttle rod 90 shows the direction of the shuttle during actuation of the pneumatic driven ball thrower.

Figure 4:
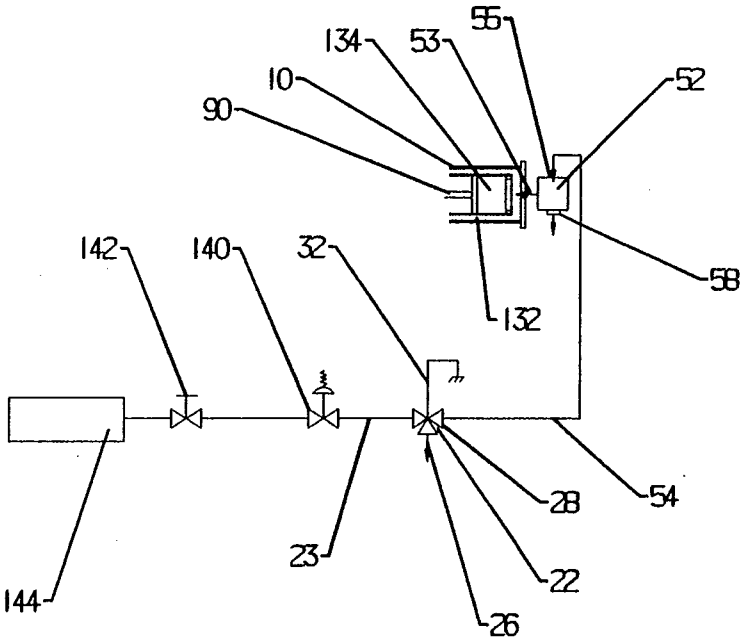
FIG. 4 is a schematic diagram of the gas operating system of the pneumatic driven ball thrower of FIG. 1.

FIG. 4 shows the gas supply system to the pneumatic driven ball thrower. Pressurized gas is fed from reservoir 144 through shut-off valve 142 to regulator 140. The gas pressure to be supplied to the device is regulated with regulator 140. Gas is supplied from the regulator through tube 23 through the three-way valve 22 via intake port 24. In normal operation, the valve communicates between intake port 24 and outlet port 28 allowing the gas to pass through the valve into tube 54 and hence into the intake port 55 of three-way valve 52. In normal operation, intake valve 52 has its intake port 55 in direct communication with its intake, outlet port 53 which is in communication with the fourth plenum 130 described above. When the trigger of valve 22 is actuated through trigger 34 and trigger rod 32, gas inlet port 24 is shut off and gas outlet port 28 is placed in communication with exhaust port 26 permitting pressurized gas in line 54 to exhaust to atmosphere. In turn, gas in valve 52 also exits out tube 54 causing valve 52 to be actuated wherein intake port 55 is closed off and direct communication between intake/outlet port 53 with exhaust port 58 permitting pressurized gas in the fourth plenum to exit through valve 52 to atmosphere as described above.

Figure 5:
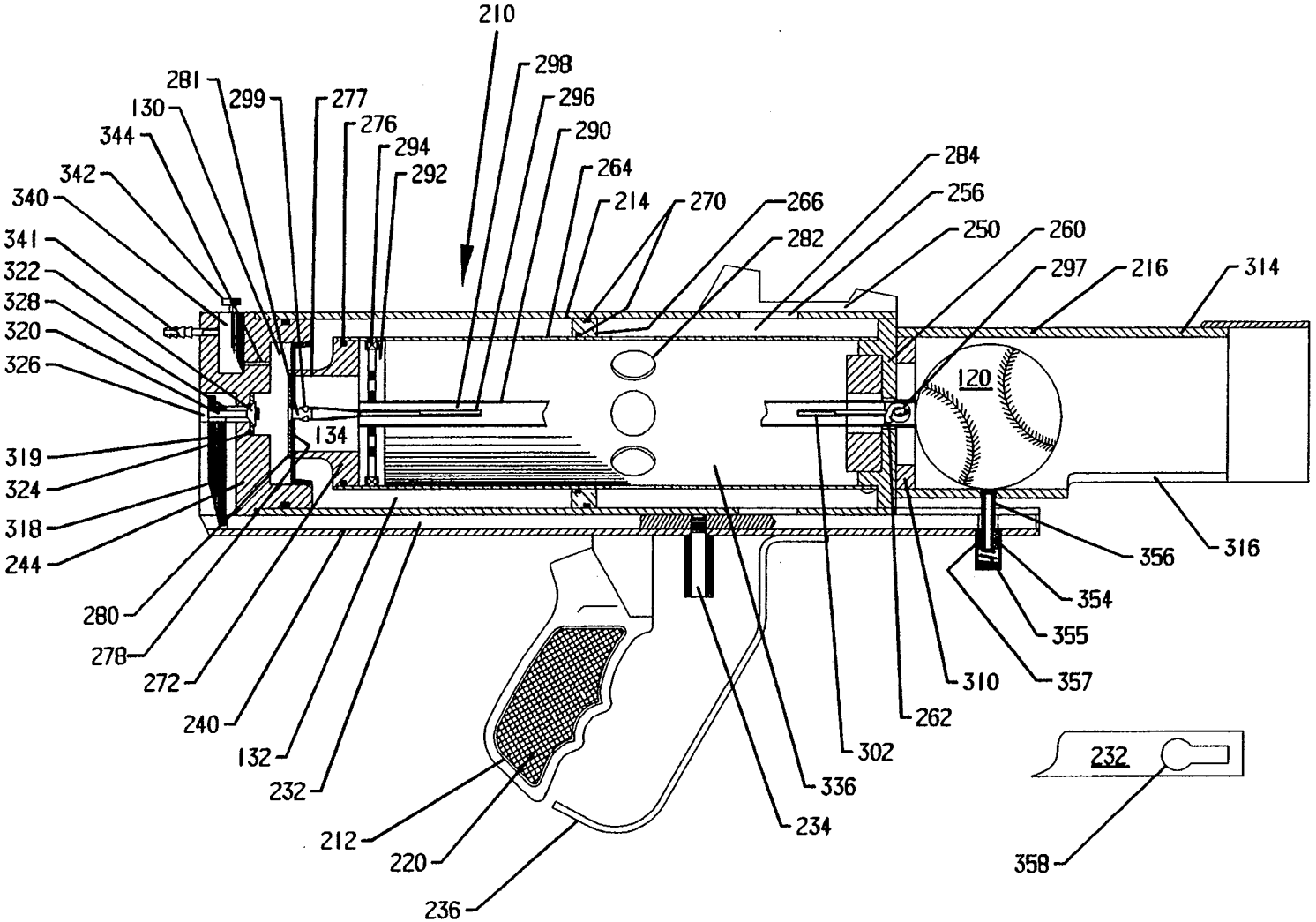
FIG. 5 is a side cross-sectional view of another embodiment of the pneumatic driven ball thrower of the present invention.
Figure 7:
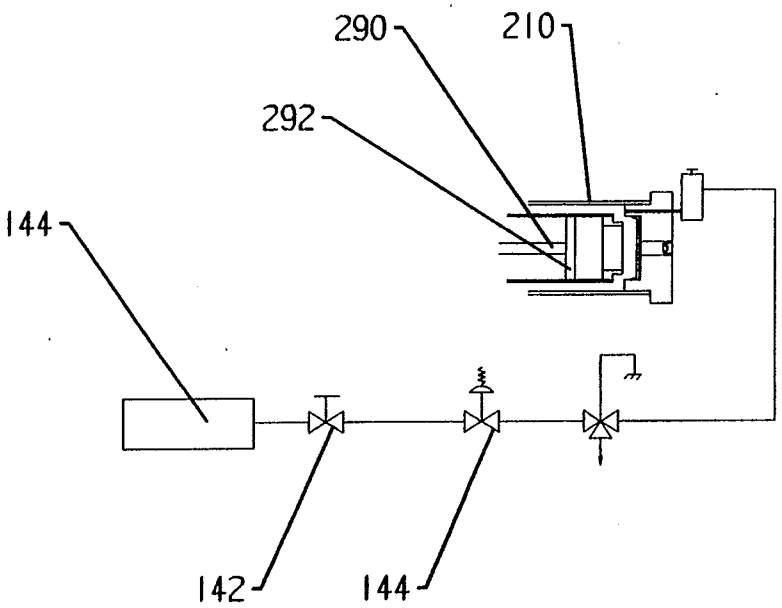
FIG. 7 is a schematic diagram of the gas supply system for the pneumatic driven ball thrower of FIG. 5.

Referring to FIG. 5, a second embodiment of the pneumatic driven ball thrower 210 of the present invention is illustrated. In a fashion similar to device 10, device 210 has a handle assembly 212 attached to a housing assembly 214 and a ball guide assembly 216 attached to the front of the housing assembly 214. The handle assembly has a hand grip 220, a trigger 234 and a trigger guard 236. The trigger is attached to a trigger actuating rod 232 which actuates the device as will be described hereinafter. The cylindrical housing 240 has a housing cap 244 attached to the rear of the housing, a sight 250 attached to the top of the housing and an end wall 260 at the front of the housing which functions as an end wall to the housing and to the cylindrical tube 264 which will be described hereinafter. Near the front of the housing, the housing has a series of gas exhaust vents 256 which are adapted to exhaust gas out of the exhaust plenum 284 in a manner similar to the function of exhaust vents 56 of the device of FIG. 10. Mounted within the cylindrical housing is cylindrical tube 264 which is supported within the housing by annular bulkhead 266 which seals the exhaust plenum 284 from the first pressure gas plenum 332. The annular bulkhead 266 is sealed to the inner wall of the housing with a cement, such as epoxy cement. The cylindrical tube is slid into the inner bore of the annular bulkhead and sealed with O-ring 270. The front of the tube is supported by the end wall 260 which is secured to the housing. A valve body 272 is secured to the rear end of the tube in a gas tight relationship. An O-ring 276 is located between the outer periphery of the valve body and the inner wall of the tube. The valve body has a throat 277 to permit the rapid transfer of gas from the first plenum 332 into the second plenum 234 as will be described hereinafter. The rear end of the valve body has a valve seat 274 adapted to receive an elastomeric flexible U cup 278 in a sealed relationship. The U cup has a backing plate 280 to reinforce the flexible U cup. A pin 281 extends through the back plate and the U cup. The pin is sealed to the elastomeric U cup to prevent gas leakage. Towards the front of the tube, the tube has a series of exhaust vents for exhausting gas from the second plenum 334 and the third plenum 336 into the exhaust plenum 284.

Mounted within cylindrical tube 264 is a shuttle assembly comprising shuttle piston 292 and hollow shuttle rod 290. The rear end of the hollow shuttle rod is attached to the piston in a gas sealed relationship which prevents gas from passing from one side of the piston to the other side of the piston at the juncture where the shuttle rod is attached. The front end of the shuttle rod is slidably received within bore 262 of the end wall. The piston and rod are adapted to be driven down the length of the tube towards the front end by pressurized gas entering the second plenum 234 from the pressurized gas first plenum 232 and is adapted to be biased back to the rear of the tube after the pressurized gas in the second plenum has exhausted through the exhaust vents 282 by elastomeric tubing 296 which is attached at its rear end to the pin 281 by clamp 299 and is attached at the front end of the shuttle by a non-slip knot 297 tied into the tubing in front of sleeve 302 forced fit into the hollow bore 290 of the rod.

The ball guide assembly 216 comprises a cylindrical guide 314 which is secured at its rear end to the annular base plate 310. The front of the ball guide 314 has a large slot 316 which permits the ball to be inserted into the ball guide and pushed down the length of the ball guide to insure that the ball is seated against the front 300 of the shuttle rod.

The trigger 234 is secured to the slidable trigger actuating rod 232. When the device is charged with a ball 120, the trigger can be actuated by pulling it back, which in turn pulls the trigger actuating rod back 232 against a pivot arm 318. The top of the arm 318 is joined to valve stem 320. When the pivot arm 318 is pivoted about pivot axis 319, the valve stem is moved forward moving poppet valve body 322 forward away from the valve seat 324 permitting pressurized gas in the fourth plenum 330 to exit out of the gas release passage 326 which quickly vents any pressurized gas in the fourth plenum and quickly brings it to atmospheric. The pivot arm 318 is biased with a coil spring 328 to return to its original position forcing the trigger actuating arm forward and the trigger 234 forward. This in turn, permits the poppet valve to close against the valve seat thus sealing off the fourth plenum.

A ball is required to charge the device 10 before the trigger can be actuated for safety purposes. The shuttle moves rapidly and it is dangerous to allow the shuttle to move without any load, such as a ball, being applied to it. If fingers were located inside the ball guide when the shuttle is released, the fingers could be severely damaged by the rapidly accelerating shuttle. Accordingly, the device has been fitted with a spring loaded safety pin 354 at the forward end of the device underneath the ball guide assembly. The safety pin is biased by a spring 355 to move upward so that the narrow shank 256 impinges a short distance, such as ⅛–3/16 of an inch, into the ball guide space. The trigger actuating arm 358 receives the larger shank area 357 in slot 358 when the device is not charged with a ball preventing the actuating arm from being moved. When a ball is charged into the device, the spring loaded safety pin is pushed down flush with the inner wall of the ball guide which in turn causes the large shank area of the safety pin to be pushed down below the trigger actuating arm. At this point, the trigger actuating rod slot 358 can slide along the narrow shank 356 permitting the trigger mechanism to operate.

The safety pin length and the safety pin bore in the ball guide will often have to be adjusted when the ball guide longitudinal axis is placed off-center with respect to the shuttle rod to put spin on the ball.

Figure 6:
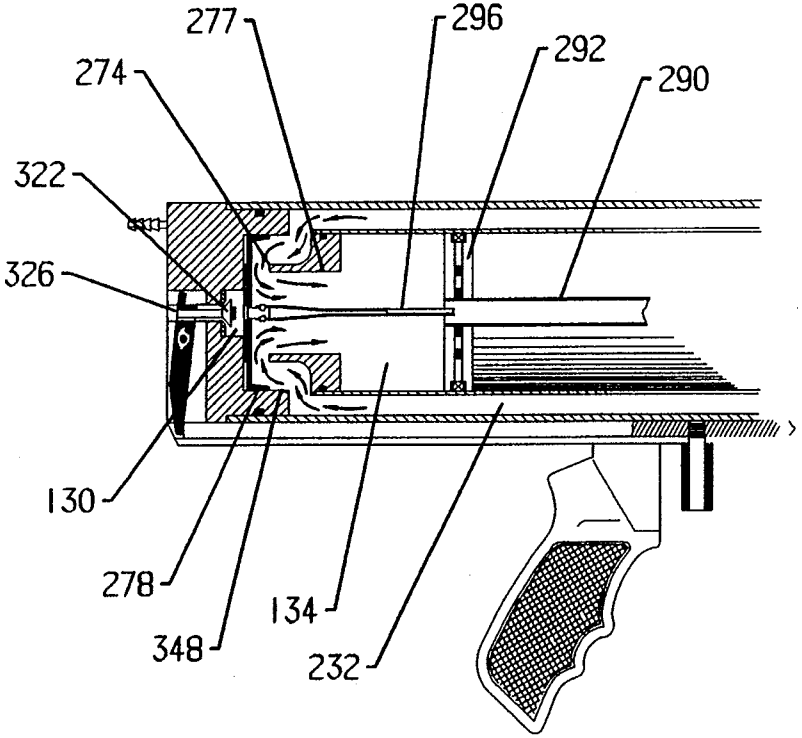
FIG. 6 is a partial side cross-sectional view similar to FIG. 5 showing operation of the pneumatic driven ball thrower of FIG. 5.

The operation of the embodiment shown in FIG. 5 and FIG. 6 is substantially similar to the operation of the embodiment 10 shown in FIGS. 1–3. However, the trigger mechanisms of the two devices are different although both embodiments permit the rapid flow of pressurized gas from the first plenum to the second plenum to insure that the shuttle is pressurized rapidly so that it accelerates rapidly to give the ball the greatest velocity in the shortest shuttle stroke.

After the device has projected a ball, the poppet valve 322 closes, the shuttle piston 292 returns to the rear end of the tube 264 and the U cup seals itself against the valve seat 274 of the valve body as described above. The gas regulator 340 senses that the fourth plenum is at atmospheric and opens, permitting the flow of the gas from a gas reservoir (not shown) through the gas regulator inlet port 341 and the gas regulator into the gas outlet port 344 which vents into the fourth plenum 130. The pressurized gas quickly pressurizes the fourth plenum, causing a pressure differential between it and the first plenum which is at atmospheric. The outer edges of the U cup 278 bend forward due to the gas pressure differential permitting the flow of gas between the U cup edges and the wall of the fourth plenum into the pressurized gas first plenum 232. When the gas pressure in the first plenum and fourth plenum are equalized, the outer edges of the elastomeric flexible U cup return to their original configuration permitting the flanges of the U cup to seal against the inner wall 348 of the fourth plenum. The backing plate 280 prevents the U cup from bulging in the center or becoming misshaped to allow gas to enter into the second plenum. When the regulator 340 senses that the gas pressure in the fourth plenum is equalized to the set gas pressure as adjusted by the gas regulator adjustment screw 342, the regulator shuts off the gas to outlet port 344.

The ball guide assembly is charged with a ball 120 thus permitting the trigger mechanism to be actuated. The operator points the device where it wants the ball to go. For example, the operator can point it from home plate towards center field at a high angle to simulate a high fly ball to the center field. The operator depresses the trigger which causes the trigger actuating rod 232 to the rear of the device which causes pivot arm 318 to pivot, forcing the poppet valve 322 to open. The poppet valve is designed such that when it is partially open, the high pressure gas in the fourth plenum springs open the poppet valve rapidly, permitting the rapid exhaust of gas from the fourth plenum to atmospheric through the gas passage 326. Almost immediately and in less than 0.01 seconds, a high pressure differential is exerted across the outer areas of the U-cup 278 by the gas pressure in the pressurized gas plenum 232 causing the U cup to move backwards into the fourth plenum. This immediately opens a gas passage between the pressurized gas first plenum 332 into the second plenum 334. The outer edges of the U cup are not deflected by the pressure differential because of the U cup right angle flanges that slidably seal against the fourth plenum wall due to the pressure in the fourth plenum. Because of the wide passageway between the first plenum and second plenum, the piston receives, almost immediately, the full force of the pressurized gas causing the shuttle piston and shuttle rod to rapidly accelerate and move downwardly in the tube. The front of the rod 300 pushes against the ball, rapidly accelerating the ball. Similarly as in device 10, the shuttle continues to accelerate until it passes the exhaust vents 282 wherein the second plenum and first plenum are exhausted to atmospheric through the exhaust plenum 284 and the housing exhaust vents 256. The pressurized gas in the third plenum 336 acts as an accumulator as described above with respect to device 10 and brakes the shuttle motion and rebounds the shuttle back past the exhaust vents 282. The elastomeric tubing 298 completes the return of the shuttle piston and rod back to the rear of the tube and forces the closing of the U cup onto the valve seat 274 to seal off the first plenum from the second plenum. The gas regulator senses that the fourth plenum is at atmospheric pressure and opens up the regulator valve permitting pressurized gas to enter into the fourth plenum and into the first plenum as described above.

The pivot arm is spring loaded to a closed position so that once the trigger is released, the poppet valve is closed, the trigger actuating arm is moved towards the front of the device and the trigger returns to its original position. When the trigger has seated home, the safety pin seats home in the actuating rod arm slot 358 preventing the trigger from being actuated until the device is once again charged with a ball.

In FIG. 5, the device is illustrated with a ball guide shield. The lengths of the ball guide and shield exceed the stroke lengths of the shuttle rod so that the shuttle rod can never extend out beyond the shield. However, the shuttle rod stroke will extend at least half way into the shield. The ball guide can be mounted co-axially with the shuttle rod for straight throws or mounted off axis with the shuttle rod to place a spin on the ball for curved throws. When mounted off axis, the ball spin does not become pronounced until the ball enters the ball guide shield where the ball is free of contact with the ball guide walls. Although the device can be used without a shield, spin throws are best achieved with a device filled with a ball guide shield and a shuttle rod whose stroke extends into the shield.

It has been found that the device works best when there is an expansion ratio between about two and about five. The expansion ratio is the volume of the first plenum plus the volume of the stroke volume of the second plenum when expanded to the exhaust vents 82 or 282 divided by the volume of the first plenum. The stroke volume is the volume of the second plenum to the tube exhaust vents. The present device is capable of propelling balls to more than 90 mph and can routinely be used to project balls between 40 and 90 mph for practicing catching and batting. It has been found that when the first plenum is pressurized to about 16½ lbs./sq. inch (psi) the device can project balls at about 20 mph; when the first plenum is pressurized to about 31 psi, the device can project balls to about 30 mph; when the first plenum is pressurized to about 67 psi, the device can project balls to 40 mph; when the first plenum is pressurized to about 109 psi, the device can project balls at 50 mph; when the first plenum is pressurized to a pressure of about 155 psi, it can project balls to 60 mph; and when the first plenum is pressurized to about 204 psi, the device can project balls to 70 mph. The first plenum is charged to a pressure of about 300 psi to project a ball to 90 mph.

What is claimed is:

1. A pneumatic ball thrower comprising:

a first plenum adapted to receiver and store pressurized as;

a shuttle comprising a piston and connecting shuttle rod adapted to be driven by the pressurized gas in said first plenum and to drive a ball to a predetermined velocity;

a tube having a wall and first and second opposing ends adapted to slidably receive the piston in a gas tight relationship to guide the piston when driven pneumatically from the first end towards the second end of said tube, said tube having at least one gas release vent in its wall located towards said second end so that when the piston is driven toward the second end of said tube and past the gas release vent, the pressurized gas in said first plenum exhausts through gas release vent to the atmosphere;

a second plenum situated at the first end of said tube to receive the pressurized gas form said first plenum, the piston forming one wall of said second plenum the second plenum expanding when said piston is driven by pressurized gas admitted into the second plenum from the first plenum;

a first valve for releasing pressurized gas from the first plenum into the second plenum in less than 0.01 seconds; and a ball guide having open opposing first and second ends, the first end of said ball guide secured to the second end of said tube, said piston adapted to drive said shuttle rod within said ball guide to drive a ball along and out of said ball guide at a predetermined velocity.

2. The pneumatic driven ball thrower according to claim 1 wherein the second end of said tube is capped with an end plate, the end plate having a bore to slidably receive and guide the shuttle rod; and a third plenum located between the piston and the end plate, said third plenum acting as an accumulator when said piston is driven down the tube past said gas release vent to brake the motion of the shuttle.

3. A pneumatic ball thrower comprising:

a first plenum adapted to receive and store pressurized gas;

a shuttle comprising a piston and connecting shuttle rod adapted to be driven by the pressurized gas in said first plenum and to drive a ball to a predetermined velocity;

a tube having first and second opposing ends adapted to slidably receive the piston in a gas tight relationship to guide the piston when driven pneumatically from the first end towards the second end of said tube, the first end of said tube is adapted to be sealed off with a first valve, the first valve sealing off said first plenum from said second plenum, said first valve actuated by pressurized gas from a fourth plenum, release of the pressurized gas from the fourth plenum rapidly opening said first valve causing pressurized gas from said first plenum to enter said second plenum in less than 0.01 seconds to drive the shuttle down the tube;

a second plenum situated at the first end of said tube to receive the pressurized gas from said first plenum, the piston forming one wall of said second plenum the second plenum expanding when said piston is driven by pressurized gas admitted into the second plenum form the first plenum; and a ball guide having open opposing first and second ends, the first end of said ball guide secured to the second end of said tube, said piston adapted to drive said shuttle rod within said ball guide to drive a ball along and out of said ball guide at a predetermined velocity.

4. The pneumatic driven ball thrower according to claim 3 wherein said first valve comprises a flexible elastomeric diaphragm backed by a fourth plenum which can receive and store pressurized gas, the pressurized gas in the fourth plenum causing the elastomeric diaphragm to stretch and seal and cover the first end of said tube to seal off said first plenum from said second plenum, the release of the pressurized gas from the fourth plenum causing the elastomeric diaphragm to contract rapidly back to its original shape and rapidly open a gas passage for pressurized gas from said first plenum to said second plenum.

5. The pneumatic driven ball thrower according to claim 4 wherein the fourth plenum is connected to a three-way valve which permits the fourth plenum to be charge with pressurized gas or permits the fourth plenum to vent the pressurized gas to the atmosphere.

6. The pneumatic driven ball thrower according to claim 5 wherein the flexible diaphragm forms one wall of said first plenum, the diaphragm adjacent to area of said first plenum having a small hole communicating between said first plenum and said fourth plenum which permits the first plenum to be charged with pressurized gas from the fourth plenum when the fourth plenum is charged with pressurized gas, the hole in said diaphragm having a cross-sectional area substantially less than the cross-sectional area of the gas passage between said first plenum and said second plenum when said first valve is open.

7. The pneumatic driven ball thrower according to claim 3 wherein said first valve comprises flexible elastomeric diaphragm which covers and seals off the first end of said tube and seals said first plenum from said second plenum, the back side of said diaphragm forming one wall of said fourth plenum, the diaphragm adapted to move in and out of the fourth plenum to open and close the first end of said tube, pressurization of the fourth plenum with pressurized gas causing the diaphragm to move out of the fourth plenum and seal the first end of said tube, the pressurized gas deflecting the edges of the diaphragm causing pressurized gas to escape from the fourth plenum into the first plenum until the gas pressure in said first plenum and said fourth plenum are equal wherein the diaphragm restores its original shape and seals off said first plenum from said fourth plenum, the release of pressurized gas from the fourth plenum causing said diaphragm to move rapidly into said fourth plenum causing rapid opening of a gas passage between said first plenum and said second plenum to drive said shuttle down the tube.

8. The pneumatic driven ball thrower according to claim 7 wherein the shuttle rod is hollow and has biasing means extending within the shuttle rod and along the length thereof, one end of the biasing means being connected to the diaphragm, the other end of the biasing means being attached to the first end of the shuttle rod, the biasing means forcing the shuttle to return to the first end of said tube after the pressurized gas in the first and second plenums has vented to atmospheric and forcing said diaphragm to move out of said fourth plenum and seal off said first plenum from said second plenum.

9. The pneumatic driven ball thrower according to claim 7 wherein the fourth plenum in communication with an atmospheric vent assembly comprising a gas passage to the atmosphere and a poppet valve to open and close said gas passage, a trigger mechanically connected to the poppet valve adapted to open the poppet valve to permit pressurized gas in the fourth plenum to vent to atmospheric.

* * * * *